US009231307B2

(12) United States Patent
Huang et al.

(10) Patent No.: US 9,231,307 B2
(45) Date of Patent: Jan. 5, 2016

(54) MONOPOLE ANTENNA

(71) Applicant: Arcadyan Technology Corporation, Hsinchu (TW)

(72) Inventors: Chih-Yung Huang, Taichung (TW); Jian-Jhih Du, Taipei (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 196 days.

(21) Appl. No.: 14/188,662

(22) Filed: Feb. 24, 2014

(65) Prior Publication Data

US 2014/0285392 A1 Sep. 25, 2014

(30) Foreign Application Priority Data

Mar. 20, 2013 (TW) ..... 102109902 A

(51) Int. Cl.
*H01Q 1/24* (2006.01)
*H01Q 9/30* (2006.01)
*H01Q 5/371* (2015.01)

(52) U.S. Cl.
CPC . *H01Q 9/30* (2013.01); *H01Q 5/371* (2015.01)

(58) Field of Classification Search
CPC ..... H01Q 5/371; H01Q 5/357; H01Q 5/364; H01Q 9/0407; H01Q 90/06; H01Q 9/30
USPC ..... 343/702, 795, 825, 826, 828, 829, 830, 343/843
See application file for complete search history.

(56) References Cited

U.S. PATENT DOCUMENTS 7,417,588 B2 * 8/2008 Castany ..... H01Q 1/22 343/700 MS
7,535,431 B2 * 5/2009 Rowell ..... H01Q 1/243 343/846
8,188,925 B2 * 5/2012 DeJean ..... H01Q 9/40 343/700 MS

FOREIGN PATENT DOCUMENTS

CN 1855622 A 11/2006
CN 201149897 Y 11/2008
TW M423366 U 2/2012

OTHER PUBLICATIONS

Taiwanese Office Action dated May 25, 2015.

* cited by examiner

*Primary Examiner* — Khai M Nguyen
(74) *Attorney, Agent, or Firm* — Rabin & Berdo, P.C.

(57) ABSTRACT

A monopole antenna printed on a substrate is provided. The monopole antenna includes a main body, an extension part, a connection part, a signal feeding terminal, and a ground plane. The main body has a first terminal and a second terminal, and further includes a width varying part and two folds, wherein the width varying part is disposed between the two folds. The extension part is extended toward a first inclined direction of the monopole antenna. The connection part connects the first terminal of the main body and the extension part. The signal feeding terminal is electrically connected to the connection part. The ground plane is adjacent to the signal feeding terminal.

12 Claims, 2 Drawing Sheets

MONOPOLE ANTENNA

This application claims the benefit of Taiwan application Serial No. 102109902, filed Mar. 20, 2013, the subject matter of which is incorporated herein by reference.

BACKGROUND OF THE INVENTION

1. Field of the Invention

The invention relates in general to a monopole antenna.

2. Description of the Related Art

In a small-sized communication product (such as a wireless router) or a communication product with built-in antenna, the antenna size affects the overall disposition of elements. Thus, the smaller the antenna, the more convenient the overall disposition of elements, and the smaller the size of communication products.

If it needs to have components of the antenna formed on the back of a circuit board to compensate the length of the antenna, dual-layer circuit board or multi-layer circuit board will be required, and the antenna cost will increase accordingly. If the antenna requires a ground terminal, the area/size of the antenna will increase.

SUMMARY OF THE INVENTION

According to one embodiment of the present invention, a monopole antenna printed on a substrate is provided. The monopole antenna includes a main body, an extension part, a connection part, a signal feeding terminal, and a ground plane. The main body has a first terminal and a second terminal, and further includes a width varying part and two folds, wherein the width varying part is disposed between the two folds. The extension part is extended toward a first inclined direction of the monopole antenna. The connection part connects the first terminal of the main body and the extension part. The signal feeding terminal is electrically connected to the connection part. The ground plane is adjacent to the signal feeding terminal. The first inclined direction is extended towards the width varying part from the connection part. The width varying part includes two terminals, wherein the width of the width varying part gradually varies. The total width of the two folds and the width varying part is not larger than the width of the ground plane. Area vertically under the main body, the extension part, the connection part, the main body extending portion and the signal feeding terminal does not have any other metal patterns or elements.

According to another embodiment of the present invention, the monopole antenna further includes a main body extending portion connecting a second terminal of the main body. The main body extending portion is extended toward a second inclined direction of the monopole antenna. The second inclined direction is extended towards the ground plane from the second terminal of the main body. The first inclined direction and the second inclined direction are opposite to each other.

The above and other contents of the invention will become better understood with regard to the following detailed description of the preferred but non-limiting embodiment (s). The following description is made with reference to the accompanying drawings.

DETAILED DESCRIPTION OF THE INVENTION

Figure 1:
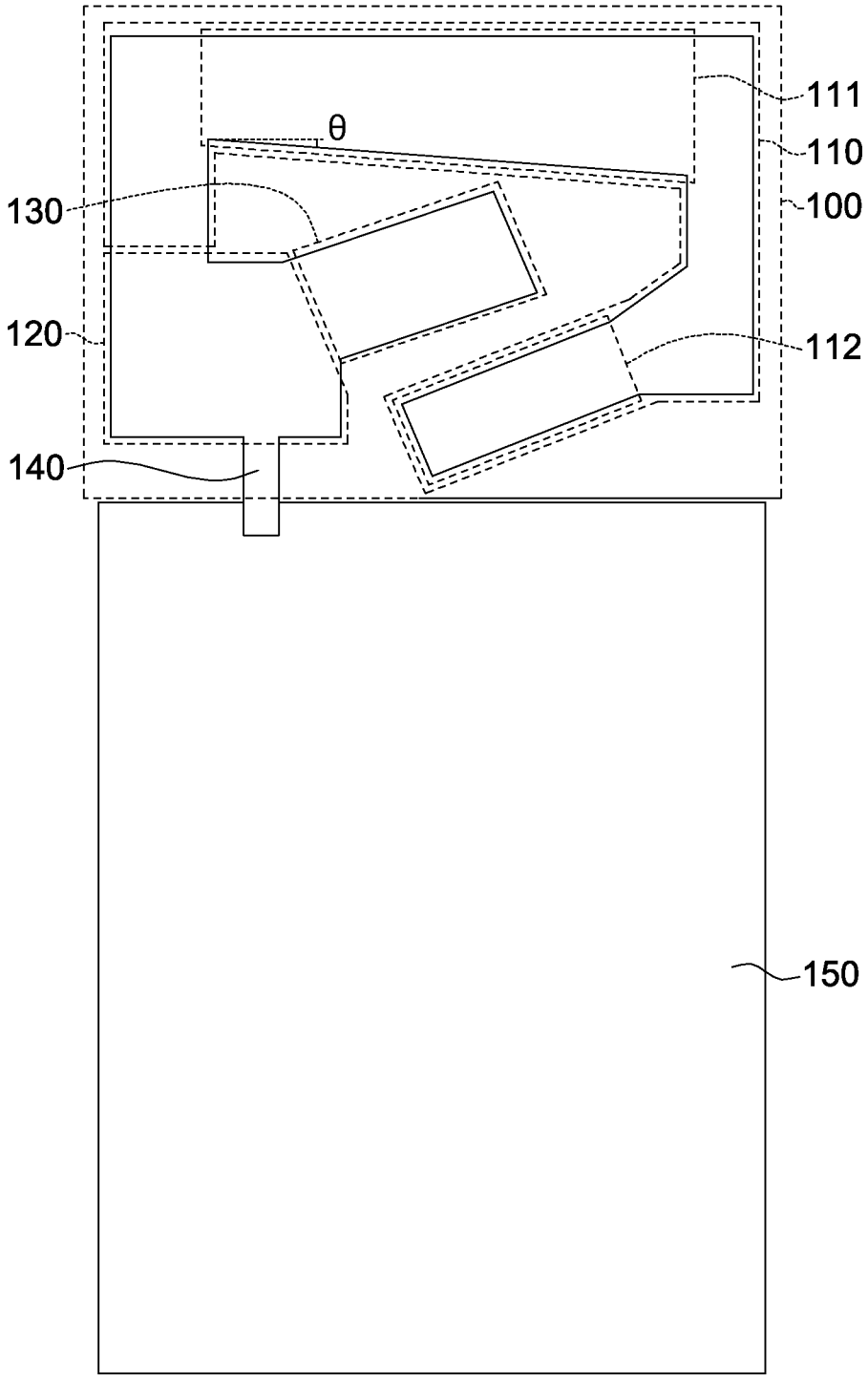
FIG. 1 is a schematic diagram of a monopole antenna according to an embodiment of the disclosure.

Referring to FIG. 1, a schematic diagram of a monopole antenna according to an embodiment of the disclosure is shown. As indicated in FIG. 1, the monopole antenna 100 includes a main body 110, a connection part 120 and an extension part 130. The monopole antenna 100 of the present embodiment of the disclosure is printed on a printed circuit board.

The main body 110 is a main radiator body of the monopole antenna 100. The radiator of the main body 110 is extended to an appropriate resonance length. For example, the radiator length of the main body 110 of the antenna is about a quarter of a resonance wavelength of an operation frequency. The main body 110 having such length is capable of transmitting/receiving an antenna radio frequency signal. The operation frequency of the monopole antenna of the present embodiment of the disclosure is between 2.40~2.50 GHz.

As indicated in FIG. 1, the main body 110 has two folds: one is formed by folding the main body 110 from the left side of FIG. 1 upwards, and the other is formed by folding the main body 110 from the top side of FIG. 1 rightwards. In other words, one fold of the main body 110 is formed by folding the left side of the monopole antenna 100 towards the top side, and the other fold is formed by folding the top side of the monopole antenna 100 towards the right side, wherein two terminals of the top side are connected to a terminal of the left side and a terminal of the right side respectively.

As indicated in FIG. 1, the main body 110 includes a width varying part 111 and a main body extending portion 112. The width varying part 111 is between the two folds of the main body 110, and can be used for adjusting impedance matching of the monopole antenna 100 so that voltage standing wave ratio (VSWR) of the monopole antenna 100 can satisfy the specifications and requirements of the industries. The extension part 112 is disposed at the terminal end of the main body 110 at which the main body 110 is connected to the connection part 120. By adjusting the length of the main body the extension part 112, the radiator of the main body 110 of the antenna can be extended to an appropriate resonance length. The width varying part 111 and the main body extending portion 112 can be a rectangle or a quadrilateral.

As indicated in FIG. 1, one side of the width varying part 111 of the monopole antenna 100 is inclined (that is, an included angle θ between this side and a horizontal reference line is not 0 degree), so that the width of the main body 110 at the width varying part 111 gradually changes. If the width of the width varying part 111 is changed, the frequency band of the antenna will be increased or changed. That is, the width of the width varying part 111 of the main body 110 is related to an operation frequency of the monopole antenna 100.

The connection part 120 can be regarded as a complementary block which connects the main body 110 and the extension part 130.

The extension part 130 may be regarded as an extension of the main body 110 of the monopole antenna 100. The extension part 130 can be used for adjusting impedance matching of the monopole antenna 100, so that VSWR of the monopole antenna 100 can satisfy the specifications and requirements of the industries. For example, by adjusting the length and/or width of the extension part 130, impedance matching of the monopole antenna 100 will be adjusted accordingly. In the present embodiment, the appearance of the extension part 130 is a rectangle but can be a quadrilateral but in other possible embodiments.

The monopole antenna 100 further includes an RF signal feeding terminal 140 for feeding an RF signal transmitted from an RF signal source (not illustrated). In the present embodiment of the disclosure, the monopole antenna 100 is a single-end feeding. That is, the monopole antenna 100 includes a single RF signal feeding terminal 140.

It can be seen from FIG. 1 that in the present embodiment of the disclosure, the main body 110, the connection part 120, the extension part 130 and the RF signal feeding terminal 140 are metal structures integrally formed in one piece (or they are in the same piece of metal).

In addition, the monopole antenna 100 is electrically connected to a ground plane 150, which is used as a ground plane of the monopole antenna. The total width of the width varying part 111 of the main body 110 and two folds is not larger than the width of the ground plane 150. It should be noted that in the disclosure, the ground plane 150 is adjacent to but not electrically connected to the RF signal feeding terminal 140.

It can be seen from FIG. 1 that in the present embodiment of the disclosure, the main body extending portion 112 and the extension part 130 are inclined, so that the antenna length and operation frequency of the monopole antenna 100 can be increased, and the leeway space of the monopole antenna 100 can be utilized without increasing the area of the antenna.

Figure 2:
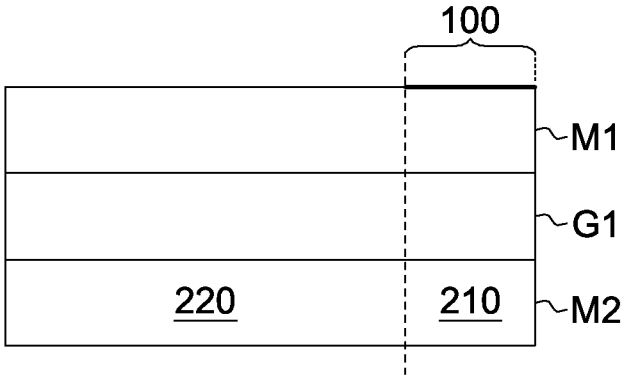
FIG. 2 is a cross-sectional view of a printed circuit board including the monopole antenna of the embodiment of the disclosure.

Referring to FIG. 2, a cross-sectional view of a printed circuit board including the monopole antenna of the present embodiment of the disclosure is shown. As indicated in FIG. 2, suppose the monopole antenna 100 is printed on the metal layer M1. Under the metal layer M1 is a dielectric layer G1, a metal layer M2 . . . and so on. The quantity of layers of printed circuit boards is based on actual needs and the tri-layer structure exemplified in FIG. 2 is not for limiting the monopole antenna of the present embodiment of the disclosure. The exemplification does not imply that the monopole antenna of the present embodiment of the disclosure can only applied in a tri-layer printed circuit board.

As indicated in FIG. 2, the area (such as the area 210 of FIG. 2) of the metal layer M2, which is vertically under the monopole antenna 100 of the metal layer M1, cannot have any metal patterns or metal elements. The reason is that in that area 210 of the metal layer M2, if there is any metal pattern or metal element disposed under the monopole antenna 100 of the metal layer M1, the metal patterns or metal elements on that area 210 of the metal layer M2 will negatively affect of signal transmission and/or receiving of the monopole antenna 100. However, other areas (such as the area 220 of FIG. 2) of the metal layer M2, which is not vertically under the monopole antenna 100 of the metal layer M1, can still have metal pattern or metal element printed or disposed to fit actual needs.

Similarly, if the printed circuit board includes more additional metal layers, the area of the additional metal layer, which is vertically under the monopole antenna 100 printed on the metal layer M1 cannot have any metal patterns or metal elements printed or disposed thereon. That is, the area(s) of the additional metal layers vertically under the main body 110, the extension part 130, the connection part 120, the main body extending portion 112 and the RF signal feeding terminal 140 cannot not have any metal patterns or elements printed or disposed thereon.

It can be seen from FIG. 2 that the monopole antenna 100 is located on one side of the dielectric layer G1, and a micro-strip line is printed on the lateral side of the dielectric layer G1. One terminal of the micro-strip line is used as the RF signal feeding terminal 140.

Figure 3:
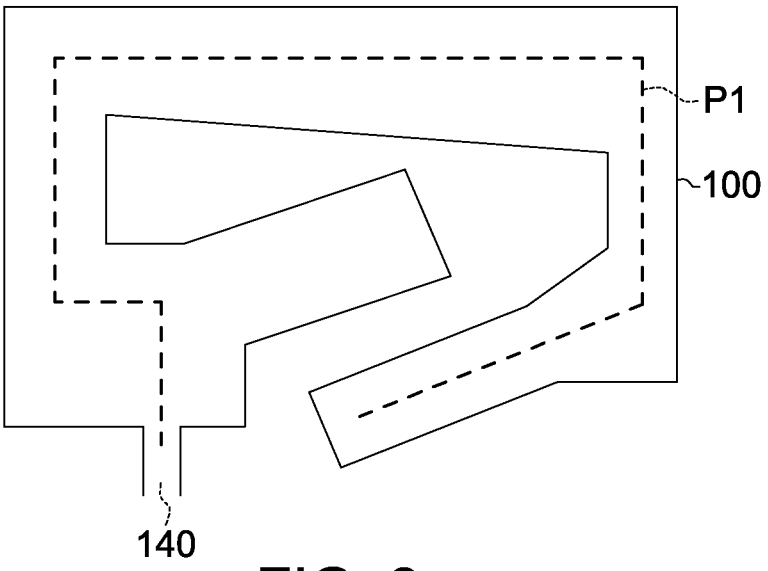
FIG. 3 is a schematic diagram of an antenna radio frequency signal path P1 according to an embodiment of the disclosure.

Referring to FIG. 3, a schematic diagram of an antenna radio frequency signal path P1 according to an embodiment of the disclosure is shown. That is, the length of the antenna radio frequency signal path P1 is about a quarter of a resonance wavelength of the operation frequency of the monopole antenna. It can be seen from FIG. 3 that the antenna length (a quarter of wavelength) includes the lengths of the main body 110 and the connection part 120 but not the length of the extension part 130.

Besides, based on the requirement of system application, the monopole antenna 100 can further electrically connected to a ground extending region (not illustrated).

The advantages of the above embodiments of the disclosure are disclosed below but are not limited thereto. It can be seen from FIG. 1 that the appearance of the monopole antenna 100 is similar to a rectangle with a small slot area. That is, the area utilization rate of the monopole antenna is high. Moreover, the monopole antenna of the present embodiment of the disclosure has an area smaller than that of generally known antennas, and is applicable to small-sized electronic products and communication products with built-in antenna.

To fine-tune the operation frequency of the antenna, the user may adjust the length of the extension part 130. Therefore, the operation frequency of the monopole antenna of the present embodiment of the disclosure can be easily adjusted to satisfy system requirements.

Generally known antennas may require a ground terminal which is electrically connected to the antenna, but the monopole antenna of the present embodiment of the disclosure does not require any ground terminal and can be further downsized.

Since the area of the monopole antenna is reduced, the area of the printed circuit board can also be reduced, hence further saving cost, and further more effectively utilizing the interior space of small-sized products or communication products with built-in antenna.

In the present embodiment of the disclosure, signal feeding of the monopole antenna is implemented to match the 50 Ohm impedance of printed circuit board and thus the embodiment does not include an external co-axial cable, hence saving the overall cost.

The monopole antenna of the present embodiment of the disclosure is a planar antenna (that is, the main body, the connection part and the extension part of the monopole antenna are on the same plane), hence saving the mold cost and assembly cost which would other occur if the antennal is not planar.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A monopole antenna printed on a substrate, the monopole antenna comprising:

a main body including a first terminal and a second terminal, the main body comprising a width varying part and two folds, wherein the width varying part is disposed between the two folds;

an extension part extended toward a first inclined direction of the monopole antenna;

a connection part connecting the first terminal of the main body and the extension part;

a signal feeding terminal electrically connected to the connection part; and a ground plane adjacent to the signal feeding terminal.

2. The monopole antenna according to claim 1, wherein, a radiator length of the main body is a quarter of a resonance wavelength of an operation frequency of the monopole antenna.

3. The monopole antenna according to claim 1, wherein, the first inclined direction is towards the width varying part from the connection part.

4. The monopole antenna according to claim 1, wherein, the extension part is a rectangle or a quadrilateral.

5. The monopole antenna according to claim 1, wherein, the main body, the connection part, the extension part and the RF signal feeding terminal are metal structures integrally formed in one piece.

6. The monopole antenna according to claim 1, wherein, a width of the width varying part of the main body is related to an operation frequency of the monopole antenna, one side of the width varying part is inclined, and an included angle between the side and a horizontal reference line is not 0 degree.

7. The monopole antenna according to claim 1, wherein, as for the two folds of the main body, one of the folds is formed by folding a first side fold of the monopole antenna towards a second side, the other of the folds is formed by folding the second side fold of the monopole antenna towards a third side, and two terminals of the second side are connected to a terminal of the first side and a terminal of the third side respectively.

8. The monopole antenna according to claim 1, wherein, the total width of the width varying part and the two folds of the main body is not larger than the width of the ground plane.

9. The monopole antenna according to claim 1, wherein, the main body further comprises a main body extending portion connecting the second terminal of the main body, and the length of the main body and the main body extending portion is related to an operation frequency of the monopole antenna.

10. The monopole antenna according to claim 9, wherein, the main body extending portion is extended toward a second inclined direction of the monopole antenna, and the second inclined direction is extended towards the ground plane from the second terminal of the main body.

11. The monopole antenna according to claim 1, wherein, a length of the extension part is related to an operation frequency of the monopole antenna.

12. The monopole antenna according to claim 9, wherein, an area of the substrate, vertically under the main body, the extension part, the connection part, the main body extending portion and the signal feeding terminal, does not include any metal pattern or element.

* * * * *